US005429094A

United States Patent [19]

Akiba et al.

[11] Patent Number: 5,429,094

[45] Date of Patent: Jul. 4, 1995

[54] FUEL PRESSURE REGULATOR

[75] Inventors: Takashi Akiba; Tatsuya Matsumoto; Masao Yonekawa; Takehiko Terada, all of Kariya, Japan

[73] Assignee: Nippondenso Co., Ltd., Kariya, Japan

[21] Appl. No.: 286,398

[22] Filed: Aug. 5, 1994

Related U.S. Application Data

[63] Continuation of Ser. No. 13,678, Feb. 3, 1993, abandoned.

[30] Foreign Application Priority Data

Feb. 4, 1992 [JP] Japan ..... 4-019237

[51] Int. Cl.[6] ..... F02M 37/04

[52] U.S. Cl. ..... 123/463; 123/467; 137/510

[58] Field of Search ..... 123/467, 447, 462, 463, 123/506; 137/510; 251/118

[56] References Cited

U.S. PATENT DOCUMENTS

| | | | |
|---|---|---|---|
| 4,237,924 | 12/1980 | Benjamin | 123/510 |
| 4,284,039 | 8/1981 | Bellicardi | 123/463 |
| 4,741,360 | 5/1988 | Affeldt | 123/510 |
| 4,756,289 | 7/1988 | Rock | 123/467 |
| 4,903,721 | 2/1990 | Maier | 137/510 |
| 4,936,342 | 6/1990 | Kojima | 123/463 |
| 4,991,556 | 2/1991 | Mahnke | 123/463 |
| 5,018,500 | 5/1991 | Triolo | 123/463 |
| 5,076,320 | 12/1991 | Robinson | 123/463 |
| 5,088,463 | 2/1992 | Affeldt | 123/456 |

FOREIGN PATENT DOCUMENTS

| | | |
|---|---|---|
| 61-1828 | 1/1986 | Japan . |
| 61-149567 | 7/1986 | Japan . |
| 61-205368 | 9/1986 | Japan . |

*Primary Examiner*—Carl S. Miller
*Attorney, Agent, or Firm*—Cushman, Darby & Cushman

[57] ABSTRACT

In a fuel pressure regulator, the interior of a housing is divided into an air chamber and a fuel chamber by a diaphragm. A throttle portion is made up of a movable valve and a valve seat provided in the fuel chamber. The valve seat includes a fuel passage in communication with a fuel outflow pipe acting as an outflow passage for the fuel. The fuel passage is formed in such a shape that its cross-sectional area is gradually increased from the inlet side toward the outlet side.

A valve seat holder includes an end face diposite to the movable valve, which end face is disposed on the same plane as an end face of the valve seat on the inlet side. The valve seat holder also includes a shoulder portion provided with a smoothly curved surface extending from the end face opposite to the movable valve to an outer peripheral side surface of the valve seat holder.

11 Claims, 7 Drawing Sheets

FUEL PRESSURE REGULATOR

This is a continuation of application Ser. No. 08/13,678, filed on Feb. 3, 1993 now abandoned.

BACKGROUND OF THE INVENTION

1. Industrial Field of the Invention

The present invention relates to a fuel pressure regulator used in a fuel injection system for an internal combustion engine.

2. Description of the Prior Art

Conventionally, a fuel injection system for an internal combustion engine includes a fuel pressure regulator for adjusting fuel pressure applied to fuel injection valves to be constant.

This fuel pressure regulator, as shown in FIG. 8, includes an air chamber 101 and a fuel chamber 102 which are separated from each other by a diaphragm 100. The fuel pressure regulator adjusts fuel pressure of the fuel chamber 102 (fuel pressure applied to fuel injection valves) to be higher than manifold negative pressure acting on the air chamber 101 by a predetermined degree (for example, 2.5 atmosphere).

When a difference between the fuel pressure and the manifold negative pressure becomes larger than the predetermined value, the diaphragm 100 is forced up to lift a movable valve 103 which moves in cooperation with the diaphragm 100. As a result, an opening degree of a throttle portion made up of the movable valve 103 and a valve seat 104 (a gap between the movable valve 103 and the valve seat 104) becomes large enough to return excessive fuel to a fuel tank (not shown), thereby maintaining the fuel pressure in the fuel chamber to be constant.

In the conventional fuel pressure regulator, when the fuel in the fuel chamber passes the throttle portion, the pressure of the fuel is abruptly decreased because the fuel is released from the high-pressure region (the fuel pressure applied to the fuel injection valves) to the atmospheric pressure circumstances, so that negative pressure or undershoot is apt to be generated at the throttle portion (a point A in FIG. 8).

In this way, the prior art has a disadvantage in that evaporation gas (evaporated fuel gas discharged into the atmosphere from a fuel system such as a fuel tank or a carburetor of an automobile) is liable to be generated owing to cavitation and deaeration caused by the occurrence of the negative pressure or the undershoot phenomenon.

At present, Evaporative Emission Control Law which restrains emission of the evaporation gas has been executed in the United States, because the evaporation gas causes air pollution. The Evaporative Emission Control Law will be further strengthened in the near future.

SUMMARY OF THE INVENTION

On the basis of the above-described circumstances, the invention aims to provide a fuel pressure regulator which can restrain occurrence of evaporation gas.

To achieve the object, according to the invention, a configuration of a fuel passage which causes the undershoot has been investigated in consideration of a position where the undershoot is generated.

As shown in FIG. 9, the positions where the undershoot is produced are found at corner portions of the movable valve 103 and the valve seat 104, and substantially at a central part of the throttle portion. It is understood from investigation of fuel flow lines at the throttle portion, that the positions where the undershoot occurs generally corresponds to positions where vortexes are generated, as illustrated in FIG. 10. Incidentally, FIGS. 9 and 10 are enlarged views each illustrative of the movable valve 103 and the valve seat 104 which constitute the throttle portion, and a part of a valve seat holder 105 in the fuel pressure regulator shown in FIG. 8.

Because it is necessary to eliminate the turbulent flow of the fuel which passes the throttle portion in order to decrease the occurrence of the undershoot, according to the invention, a shape of a fuel passage 104*a* or a relation between the valve seat 104 and the valve seat holder 105 has been investigated.

In the fuel pressure regulator of the invention, when the fuel passes the throttle portion between the movable valve and the valve seat, the fuel can flow without being disturbed because a shoulder portion of the valve seat holder is formed with a smoothly curved surface. Further, since an end face of the valve seat holder and an end face of the valve seat are disposed on the same plane as each other, the fuel flow lines (flow of fuel) are hardly turbulent.

The fuel which has passed the throttle portion is introduced to a fuel outflow pipe through the fuel passage of the valve seat. Because the fuel passage of the valve seat is formed in such a shape that its cross-sectional area is gradually increased from the side of the throttle portion to the side of the fuel outflow pipe, the number of positions where the vortexes are generated can be reduced in the region extending from the throttle portion to the fuel passage.

DETAILED DESCRIPTION OF THE PREFERRED EMBODIMENTS

A fuel pressure regulator according to a first embodiment of the invention will be described hereinafter with reference to FIGS. 1 to 5.

Figure 1:
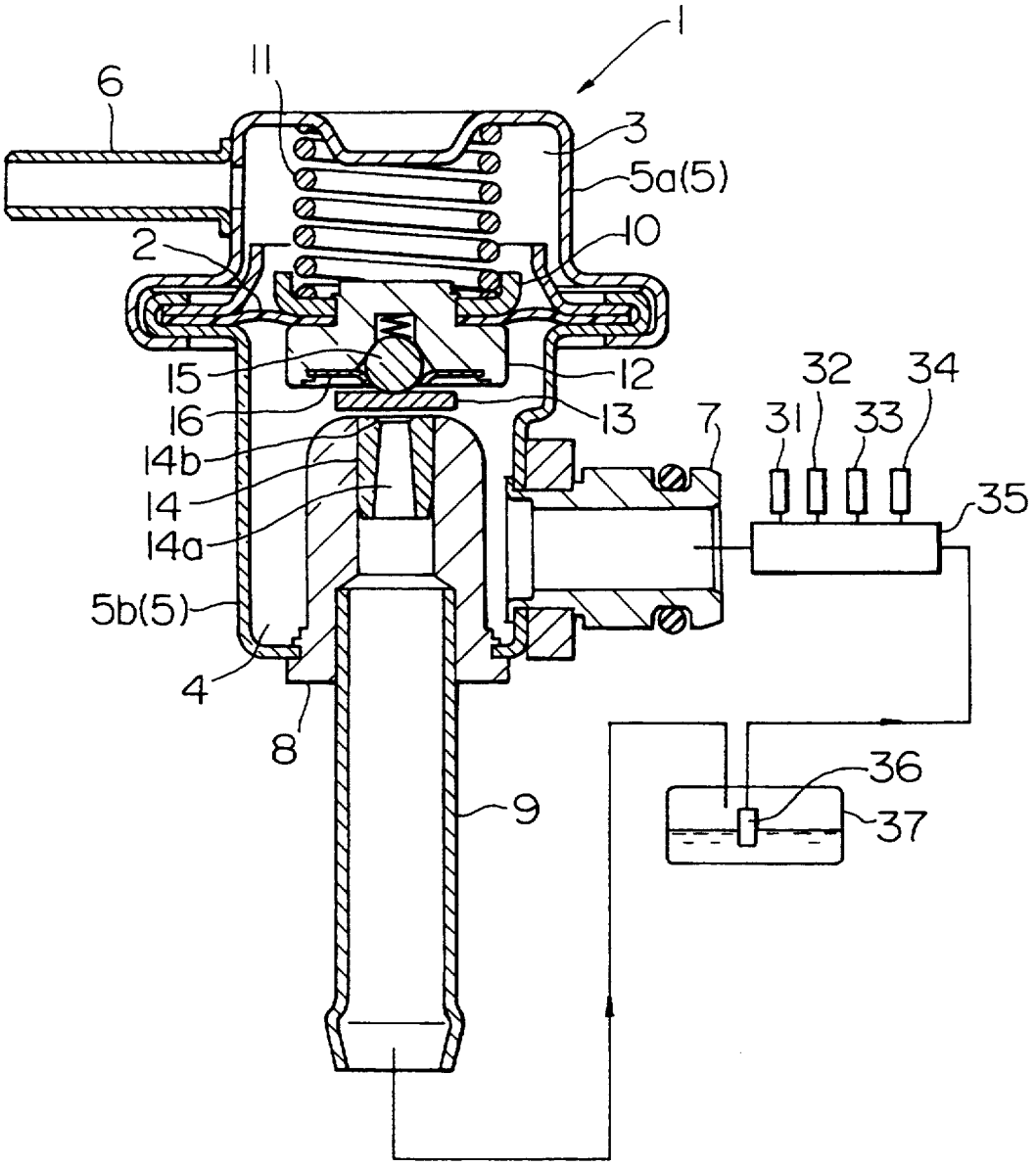
FIG. 1 is a cross-sectional view of a fuel pressure regulator according to a first embodiment of the invention.

FIG. 1 is a cross-sectional view of such a fuel pressure regulator. The fuel pressure regulator includes a housing 5 whose interior is partitioned into an air chamber 3 and a fuel chamber 4 by a diaphragm 2. The housing 5 is composed of an upper housing half 5*a* forming the air chamber 3 and a lower housing half 5*b* forming the fuel chamber 4. The upper and lower housing halves 5*a*, 5*b* are fixed to each other by deforming the lower edge of the upper housing half 5*a* to clamp the flange of the lower housing half 5*b*. The outer periphery of the diaphragm 2 is provided between both housing halves 5*a* and 5*b*.

A pipe 6 leading to an intake pipe (not shown) is connected to a side wall of the housing half 5*a* forming the air chamber 3. Pressure on the downstream side of a throttle valve is introduced into the air chamber 3 through the pipe 6.

A fuel inflow pipe 7 is welded and secured to a side wall of the housing half 5*b* forming the fuel chamber 4, which fuel inflow pipe 7 is communicated with a delivery pipe 35 to which fuel injection valves 31, 32, 33 and 34 are joined. Fuel which has passed the delivery pipe 35 is supplied into the fuel chamber 4 through the fuel inflow pipe 7. The delivery pipe 35 is supplied with the fuel from a fuel pump 36.

A fuel outflow pipe 9 (a fuel discharge passage) is provided on the bottom of the housing half 5*b*, the fuel outflow pipe 9 being supported by a valve seat holder 8 which will be described below. The fuel in the fuel chamber 4 is returned to a fuel tank 37 through the fuel outflow pipe 9.

A spring 11 for urging the diaphragm 2 toward the fuel chamber 4 is provided on a pan 10 in the air chamber 3. The pan 10 is secured to a valve retainer 12 penetrating through the diaphragm 2 at the center thereof and extending from the fuel chamber 4 to the air chamber 3. The diaphragm 2 is securely held between the pan 10 and the valve retainer 12.

In the fuel chamber 4, there are provided a movable valve 13 to which movement of the diaphragm 2 is transmitted via the valve retainer 12, and a valve seat 14. A throttle portion is formed between the movable valve 13 and the valve seat 14.

A ball 15 is attached on an upper surface of the movable valve 13. The ball 15 is held by a retaining plate 16 secured to the valve retainer 12 so that the movable valve 13 is supported by the valve retainer 12.

The valve seat 14 includes a fuel passage 14*a* leading to the fuel outflow pipe 9. The valve seat 14 is press-fitted in the cylindrical valve seat holder 8 at the upper end in such a manner that an opening end of the fuel passage 14*a* opposes to the movable valve 13.

The fuel passage 14*a* provided in the valve seat 14 is formed to have a shape (e.g., a diffuser-like shape) whose cross-sectional area is gradually increased from the inlet side (from the side of the movable valve 13) toward the outlet side (the side of the fuel outflow passage 9). The fuel passage 14*a* is provided with a chamfered portion 14*b* at the inlet portion.

The valve seat holder 8 constitutes a part of the fuel outflow passage. The valve seat holder 8 is press-fitted and secured in the bottom portion of the housing half 5*b*. The fuel outflow passage 9 is secured to the outlet side of the valve seat holder 8 by welding.

The end face of the valve seat holder 8 which opposes to the movable valve 13 is disposed on the same plane as the end face of the valve seat 14 on the inlet side thereof. A shoulder or corner portion between the end face of the valve seat holder 8 opposite to the movable valve 13 and an outer peripheral side face thereof has a smoothly curved contour.

Next, a description will be given to an operation of the fuel pressure regulator according to the invention.

The fuel pressure regulator 1 operates to control the pressure of fuel flowing into the fuel chamber, that is, the pressure of fuel supplied to the fuel injection valves at a predetermined value depending on manifold negative pressure (pressure on the down-stream side of a throttle valve) introduced into the air chamber and preset biasing load of the spring 11 against a pressure receiving area of the diaphragm 2. For example, the fuel pressure regulator controls the fuel pressure in the fuel chamber 4 (the pressure of the fuel supplied to the fuel injection valves) to be higher than the manifold negative pressure by 2.5 atmosphere.

Accordingly, when the difference between the fuel pressure in the fuel chamber 4 and the manifold negative pressure in the air chamber 3 becomes more than 2.5 atmosphere, the diaphragm 2 is forced up toward the air chamber 3 to lift the movable valve 13 (to move the same upwardly in FIG. 1), thereby increasing an opening degree of the throttle portion. As a result, excessive fuel is returned to the fuel tank through the fuel outflow pipe 9 so as to maintain the fuel pressure in the fuel chamber 4 at a constant value.

In the fuel pressure regulator 1, the shoulder portion of the valve seat holder 8 is formed to have the smoothly curved surface, and the end face of the valve seat holder 8 facing to the movable valve 13 is disposed on the same plane as the inlet side end face of the valve seat 14. For the reasons, the fuel can flow through the throttle portion under a condition of little resistance, which results in few turbulent flows of the fuel.

Figure 2:
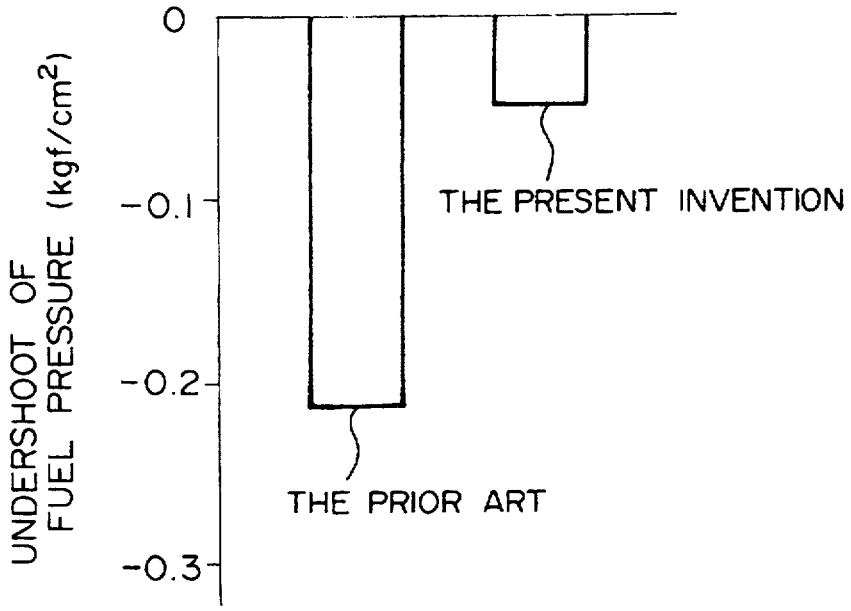
FIG. 2 is a graph showing a magnitude of undershoot generated in a fuel pressure regulator according to the invention and a magnitude of undershoot generated in a conventional fuel pressure regulator.
Figure 3:
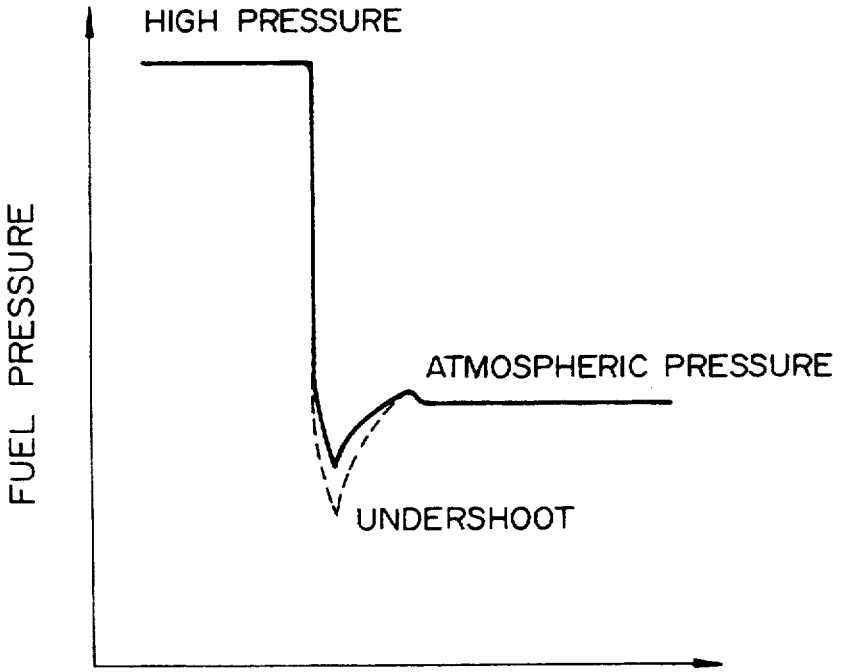
FIG. 3 is a graph of fuel pressure indicating occurrence of the undershoot.

Further, not only because the shoulder portion of the valve seat holder 8 is formed to have the smoothly curved surface and the end faces of the valve seat holder 8 and the valve seat 14 are disposed on the same plane as each other, but also because the cross-sectional area of the fuel passage 14*a* in the valve seat 14 is gradually enlarged from the inlet side toward the outlet side, the fuel can flow smoothly (in a laminar flow), so that there hardly occur vortexes in an area extending from the throttle portion to the fuel passage 14*a*. Thus, as shown in FIGS. 2 and 3, a reduction in magnitude of the undershoot can be realized. In addition, FIG. 2 is a graph indicating the undershoot magnitudes generated in the fuel pressure regulator according to the invention and a conventional fuel pressure regulator. FIG. 3 is a graph of the fuel pressure, illustrating occurrence of the undershoot.

Since a reduction in magnitude of the undershoot restrains the occurrence of cavitation and deaeration, an amount of evaporated gas generated due to the cavitation and deaeration can be decreased.

Figure 4:
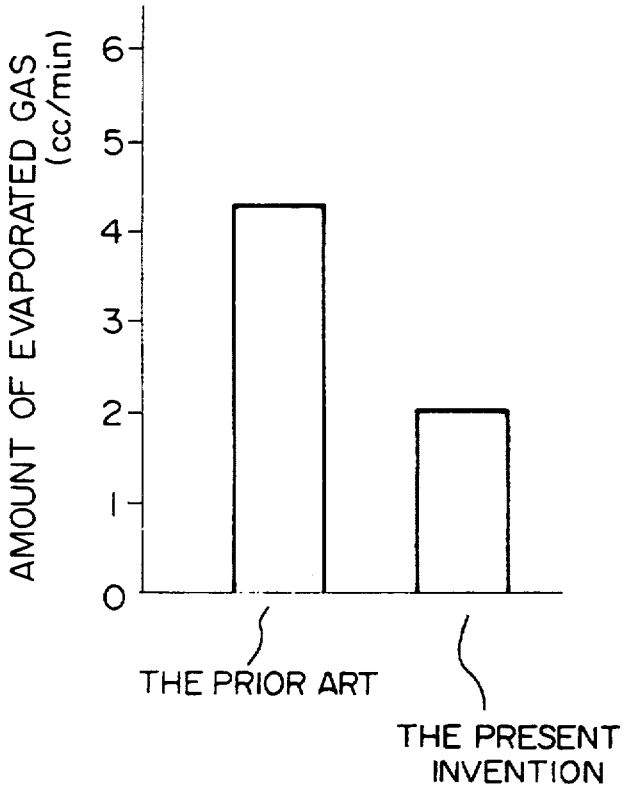
FIG. 4 is a graph showing an amount of evaporated gas in the fuel pressure regulator according to the invention and an amount of evaporated gas in the conventional fuel pressure regulator.
Figure 5:
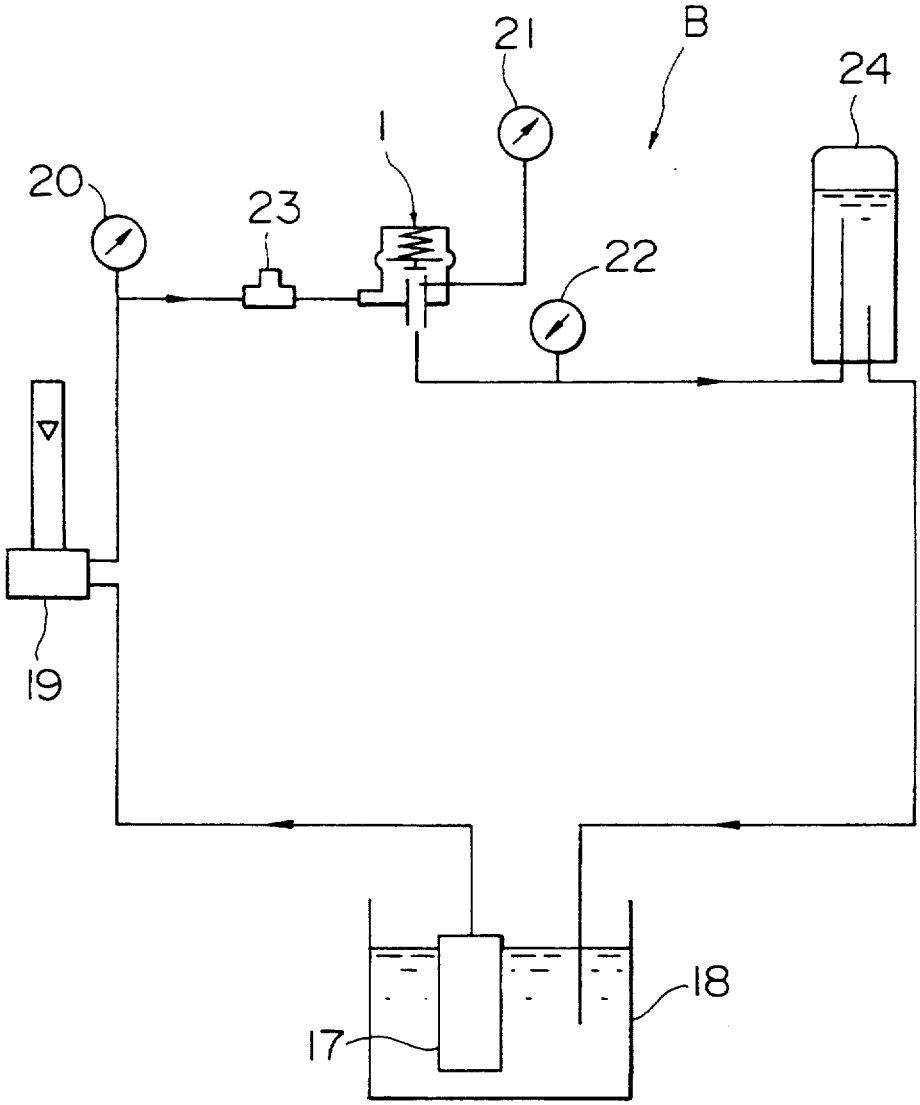
FIG. 5 is a view illustrating the whole structure of a measurement device for determining the amount of evaporated gas.

Actually, as a result of measuring an amount of generation of the evaporation gas, it is understood from FIG. 4 that substantially half of the amount can be reduced as compared with the conventional fuel pressure regulator. The amount of generation of the evaporation gas is determined by using a measurement device B shown in FIG. 5. In the measurement device B, fuel from a fuel tank 18 by a fuel pump 17, is fed to the fuel pressure regulator 1, and an amount of the evaporation gas contained in the fuel returned from the fuel pressure regulator 1 to the fuel tank 18 is determined. The measurement device B includes a flow meter 19 for measuring a flow rate of fuel, fuel pressure indicators 20, 21 and 22 respectively for measuring the fuel pressure fed into the fuel pressure regulator 1, the fuel pressure (within the fuel passage 14*a*) after being decreased at the throttle portion within the fuel pressure regulator 1 and the fuel pressure flowing out of the fuel pressure regulator 1, a fuel thermometer 23 for measuring a temperature of the fuel supplied into the fuel pressure regulator 1, and a reservoir 24 for storage of the evaporation gas. The measurements have been carried out by operating the automobile outdoors.

Figure 6:
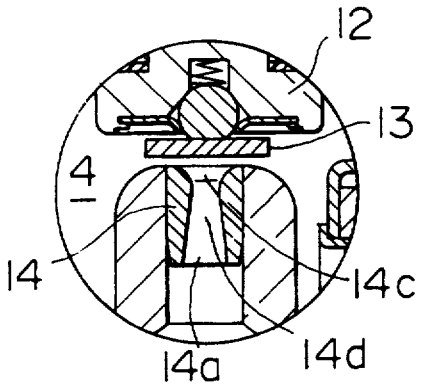
FIG. 6 is a cross-sectional view of a main portion of a fuel pressure regulator according to a second embodiment of the invention.

A second embodiment of the invention is shown in FIG. 6.

In the illustrated embodiment, a fuel passage 14*a* of a valve seat 14 includes a smoothly narrowed portion 14*c* formed in a small area at the inlet and an enlarged portion 14*d* extending from the narrowed portion 14*c* on the downstream side thereof. That is to say, as shown in FIG. 6, the fuel passage 14*a* is formed such that the cross-sectional area is largely defined at the opening end of the inlet, the cross-sectional area is decreased at the narrowed portion 14*c*, and the cross-sectional area is gradually increased toward the outlet side of the fuel passage 14*a* at the enlarged portion 14*d*.

Figure 7:
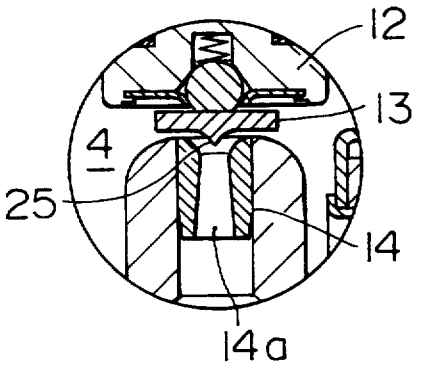
FIG. 7 is a cross-sectional view of a main portion of a fuel pressure regulator according to a third embodiment of the invention.
Figure 8:
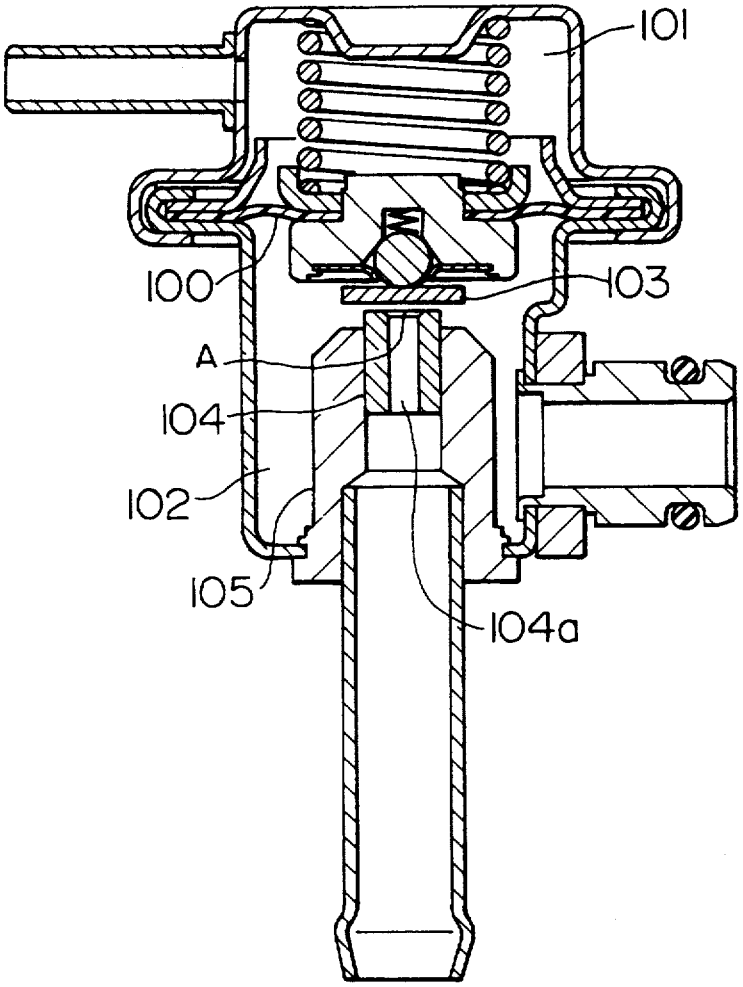
FIG. 8 PRIOR ART
FIG. 8 is a cross-sectional view of the conventional fuel pressure regulator.
Figure 9:
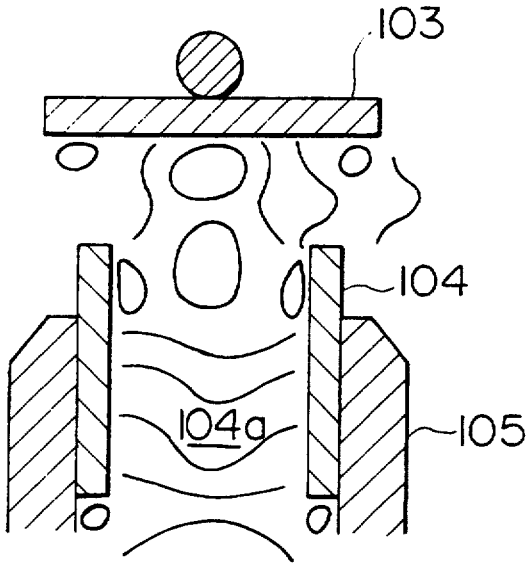
FIG. 9 PRIOR ART
FIG. 9 is a cross-sectional view of a main portion of the conventional fuel pressure regulator, showing positions where the undershoot happens.
Figure 10:
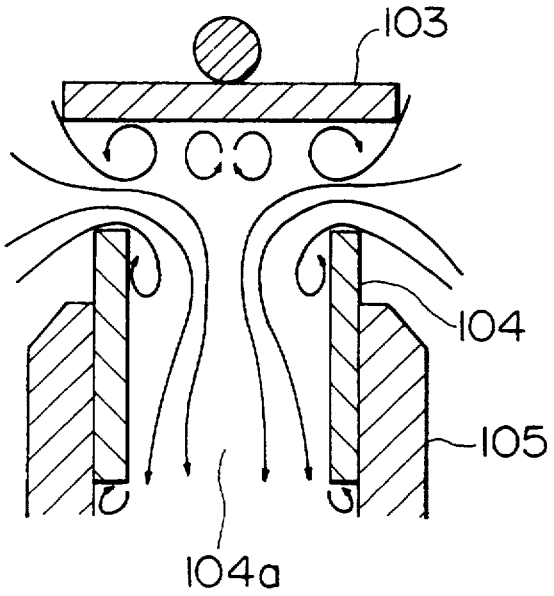
FIG. 10 PRIOR ART
FIG. 10 is a cross-sectional view of the main portion of the conventional fuel pressure regulator, explanatorily showing fuel flow lines at a throttle portion.

FIG. 7 shows a third embodiment of the invention. In this embodiment, a fuel passage 14*a* of a valve seat 14 has a shape the same as that of the second embodiment. Further, the movable valve 13 includes at the central portion a conical projection 25 protruding toward the inlet opening portion of the fuel passage 14*a*. Because the fuel flows along the projection 25, the fuel can pass the throttle portion to flow into the fuel passage 14*a* more smoothly.

As mentioned above, in the fuel pressure regulator according to the invention, the occurrence of the cavitation and deaeration resulted from the undershoot can be decreased so that the amount of the evaporated gas can be reduced.

What is claimed is:

1. A fuel pressure regulator comprising:

a housing;

a pressure receiving member which separates an interior of said housing into an air chamber and a fuel chamber and which displaces depending on the fuel pressure in said fuel chamber;

a movable valve which moves corresponding to displacement of said pressure receiving member; and an outlet member which has an outflow passage for discharging the fuel from said fuel chamber into a lower pressure space and which constitutes valve means for controlling a rate of outflow of the fuel in accordance with the displacement of said movable valve, said outflow passage having an enlarged portion with a shape whose cross-sectional area is gradually increased from an inlet of said outflow passage on a side of said fuel camber toward the downstream side there;

wherein said outlet member is formed in a cylindrical shape and projects in said fuel chamber, said inlet of said outflow passage is opened at an end face of said outlet member, and a contact portion with said movable valve is defined on said end face of said outlet member so as to constitute said valve means;

where said outlet member further includes a cylindrical valve seat holder projecting in said fuel chamber and a cylindrical valve seat which is accommodated in said valve seat holder and which has said outflow passage and said end face defining said contact portion; and where said valve seat holder includes an end face disposed on substantially the same plane as said end face of said valve seat; and wherein said valve seat holder includes an upper end having an outer peripheral surface formed into a smoothly curved surface.

2. A fuel pressure regulator according to claim 1, wherein:

said upper end of valve seat holder includes a shoulder portion having said smoothly curved surface that extends from said end face to said outer peripheral side surface of said outlet member;

wherein said smoothly curved surface prevents the outlet member from projecting sideways.

3. A fuel pressure regulator according to claim 2, wherein:

said movable valve is formed in a plate-like shape, and it contacts with said end face of said outlet member to close said inlet of said outflow passage.

4. A fuel pressure regulator according to claim 1, wherein:

said outflow passage includes a narrowed portion whose cross-sectional area is gradually reduced downwardly, said narrowed portion being formed in a small area immediately on the downstream side of the inlet of said outflow passage on said fuel chamber side, and said enlarged portion extending from said narrowed portion on the downstream side thereof. ..

5. A fuel pressure regulator according to claim 1, wherein:

said movable valve includes a projection protruded toward said outflow passage in order to guide the fuel flowing from said fuel chamber to said outflow passage.

6. A fuel pressure regulator including:

a housing;

a pressure receiving member which separates an interior of said housing into an air chamber and a fuel chamber and which displaces depending on the fuel pressure in said fuel chamber;

a movable valve which moves corresponding to displacement of said pressure receiving member; and a cylindrical member projecting in said fuel chamber, said cylindrical member having an end face where an inlet of an outflow passage for discharging the fuel from said fuel chamber to a lower pressure space is opened and where a contact portion with said movable valve is defined so as to constitute valve means for controlling a rate of outflow of the fuel from said fuel chamber to said outflow passage, and a shoulder portion provided with a smoothly curved surface extending from said end face to an outer peripheral side surface of said cylindrical member;

wherein said cylindrical member includes a cylindrical valve seat having said outflow passage and a valve seat end face defining said contact portion, and a valve seat holder which accommodates said valve seat therein and which has an end face disposed on substantially the same plane as said valve seat end face and said shoulder portion provided with the smoothly curved surface extending from said end face to the outer peripheral side surface of said valve seat holder.

7. A fuel pressure regulator according to claim 6, wherein:

said outflow passage includes an enlarged portion provided in the vicinity of said inlet, said enlarged portion being formed in a shape whose cross-sectional area is gradually increased downwardly.

8. A fuel pressure regulator according to claim 6, wherein:

said movable valve is formed in a plate-like shape and it contacts with said end face to close said inlet of said outflow passage.

9. A fuel pressure regulator including:

a housing;

a pressure receiving member which separates the interior of said housing into an air chamber and a fuel chamber and which displaces depending on the fuel pressure in said fuel chamber;

a movable valve which moves corresponding to displacement of said pressure receiving member;

a valve seat in which an inlet of an outflow passage for discharging the fuel from said fuel chamber into a lower pressure space is opened an in which a contact portion with said movable valve is formed to constitute valve means for controlling a rate of outflow of the fuel to said outflow passage; and a valve seat holder for supporting said valve seat, having a surface disposed on the same plane as said contact portion of said valve seat;

wherein said valve seat holder includes a shoulder portion provided with a smoothly curved surface extending from said end face to an outer peripheral side surface of said valve seat holder.

10. A fuel pressure regulator according to claim 9, wherein:

said valve seat is formed in a cylindrical shape, through which said outflow passage extends, and said outflow passage includes an enlarged portion in the vicinity of said inlet, said enlarged portion being formed in a shape whose cross-sectional area is gradually increased from said inlet downwardly.

11. A fuel pressure regulator according to claim 9 wherein:

said movable valve is formed in a plate-like shape and it contacts with a surface of said valve seat to close said inlet of said outflow passage.

* * * * *